United States Patent [19]

Kawashima et al.

[11] 4,021,237

[45] May 3, 1977

[54] PROCESS FOR PRODUCING CADMIUM SULFIDE FOR ELECTROPHOTOGRAPHY

[75] Inventors: Hirokuni Kawashima, Tokyo; Kiyoshi Suzuki, Kawasaki, both of Japan

[73] Assignee: Canon Kabushiki Kaisha, Tokyo, Japan

[22] Filed: Nov. 14, 1974

[21] Appl. No.: 523,895

[52] U.S. Cl. ..... 96/1.5; 252/501; 423/101; 423/561 R

[51] Int. Cl.[2] ..... G03G 5/04

[58] Field of Search ..... 96/1.5; 252/501; 423/101, 561

[56] References Cited

UNITED STATES PATENTS

| | | | |
|---|---|---|---|
| 2,879,182 | 3/1959 | Pakswer et al. | 117/201 |
| 2,995,474 | 8/1961 | Pearlman | 117/211 |
| 3,058,807 | 10/1962 | Holland | 23/134 |
| 3,506,595 | 4/1970 | Makino et al. | 96/1.5 |
| 3,743,609 | 7/1973 | Hirata et al. | 252/501 |
| 3,872,222 | 3/1975 | Barnes | 423/561 |

OTHER PUBLICATIONS

Photoconductivity of Solids, Richard H. Bube, 1960 (pp. 158–160).

*Primary Examiner*—David Klein
*Assistant Examiner*—Judson R. Hightower
*Attorney, Agent, or Firm*—Fitzpatrick, Cella, Harper & Scinto

[57] ABSTRACT

CdS for electrophotography is produced by contacting sulfide ion, cadmium ion and a donor impurity of Group IIIa or IIIb of the Periodic Table and firing the resulting CdS. An acceptor impurity may be added to the first step or the second step.

36 Claims, 1 Drawing Figure

PROCESS FOR PRODUCING CADMIUM SULFIDE FOR ELECTROPHOTOGRAPHY

BACKGROUND OF THE INVENTION

1. Field of the Invention

This invention relates to a process for producing cadmium sulfide used as a photoconductive material for electrophotography, and more particularly, to a process for producing the cadmium sulfide doped with a donor impurity of Group IIIa or Group IIIb of the Periodic Table without using a flux.

2. Description of the Prior Art

It is well known that cadium sulfide shows photoconductivity and is used as a photo-cell or a photosensitive material for electrophotography. However, when cadmium sulfide is in a form of a complete crystal structure, the photoconductivity is low and it is known that the photoconductivity is increased by crystal imperfection of cadmium sulfide itself.

This crystal imperfection of cadmium sulfide is caused by impurity contamination and the resulting photoconductive characteristics depend on the mixing state of the impurity. There are two types of impurities, that is, a donor type and an acceptor type, and examples of the former type impurity are elements of Group III and Group VII and those of the latter type impurity are elements of Group I of the Periodic Table. These impurities are usually introduced into cadmium sulfide by firing.

Cadmium sulfide used for a photo-cell and the process for production thereof are fundamentally different from that used for a photosensitive material for electrophotography and its production process. In the former case, the cadmium sulfide is sintered at an elevated temperature upon introducing the impurity to form coarse crystals since it is necessary for a photo-cell to receive a large electric current.

On the contrary, in the latter case, the particle size of the cadmium sulfide itself directly decides the resolution of electrostatic latent images so that such high temperature firing as in the case of photo-cell can not be employed. Therefore, it is necessary to dope with an impurity suppressing the crystal growth, but the doping can not be effected by firing at low temperatures so that a flux such as $CdCl_2$ is used. The firing together with a flux at a low temperature is, indeed, effective to suppress the formation of coarse crystals to some extent, but the crystals still grow resulting in crystal size of more than several microns. Consequently, even when a flux is employed, the firing temperature is kept as low as possible, the amount of flux is decreased, a crystal growth inhibiting agent is employed, the diffusion period is shortened and raw CdS of a small particle size is employed.

In view of the foregoing, there have been highly desired processes for producing an activated cadmium sulfide free from coarse crystals without using any flux. The present inventors proposed such process as U.S. application Ser. No, 476,093 filed June 3, 1974.

According to the above mentioned process, a halogen compound such as $CdCl_2$ is used as a starting material and the chlorine itself works as a donor impurity so that a flux is not necessary. Therefore, this process is a very effective one. However, the amount of chlorine acting as a donor impurity can not be maintained at a constant amount upon washing. This seems to be due to the fact that the chlorine diffused into the CdS is washed away with the washing liquor. Therefore, other treating means are necessary to retain a certain amount of a donor impurity in CdS in a diffused form. As previously mentioned, it is known that there is used an element of Group III or Group VII of the Periodic Table, but such element is relatively easily incorporated into only coarse particles such as particles used for a photocell while it is hardly incorporated into fine particles such as particles used for a photosensitive material of electrophotography. In other words, as mentioned previously, the coarse particles are sintered at high temperatures, and the high temperature firing enables a donor impurity to diffuse simply into CdS while the diffusion temperature and amount of flux are restricted in case of fine particles so that the diffusion of the donor impurity is very difficult.

SUMMARY OF THE INVENTION

According to the present invention, there is provided a process for producing CdS for electrophotography which comprises the steps of (1) contacting sulfide ion with cadmium ion and a donor impurity of Group IIIa or IIIb of the Periodic Table to form a CdS containing an impurity, and then (2) firing the CdS, and an acceptor being added at either step (1) or step (2).

An object of the present invention is to provide a process for producing CdS for electrophotography by which the amount of the doping impurity can be quantitatively controlled.

Another object of the present invention is to provide a process for producing CdS for electrophotography in which a flux is not necessary.

A further object of the present invention is to provide CdS powder produced by the above-mentioned process.

Still another object of the present invention is to provide a photoconductive layer containing the CdS powder.

A still further object of the present invention is to provide a photosensitive plate having the photoconductive layer.

DESCRIPTION OF THE PREFERRED EMBODIMENTS

Figure 1:
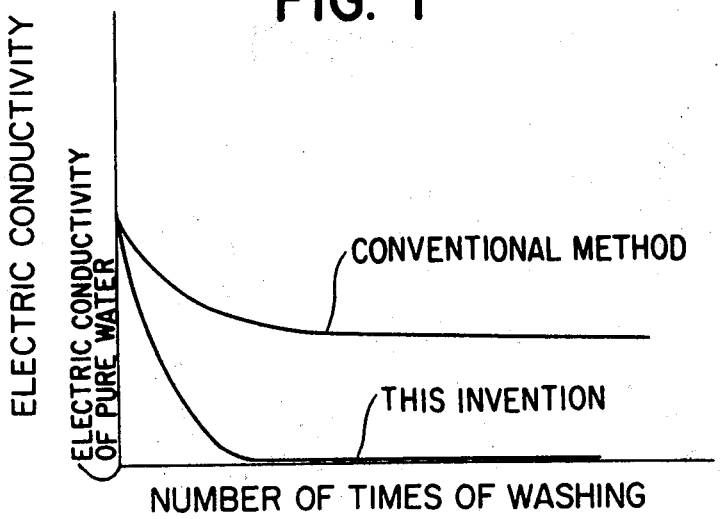
FIG. 1 shows a relationship between electric conductivity of a washing waste liquor and a number of times of washing with respect to cadmium sulfide obtained by the process of this invention and that obtained by a conventional process.

In the first step of the present invention, a donor impurity of Group IIIa or IIIb preferably in ionic form, cadmium ion and sulfide ion are brought into contact with each other in an aqueous solution to produce cadmium sulfide containing the donor impurity.

An acceptor impurity may be added to the first step or the second step since the acceptor impurity can be easily incorporated into CdS upon firing.

In the second step, the cadmium sulfide containing the donor and the acceptor added after the first step, or the cadmium sulfide containing both donor and acceptor added in the first step, is fired.

According to the present invention, the donor impurity is contained in cadmium sulfide in the first step and the donor thus contained in CdS is hardly lost during the procedure so that the donor amount remaining in the final product can be predicted based on the amount initially added. In other words, the donor amount can be quantitatively controlled. Furthermore, the second step can be effected in the presence of the donor impurity and thereby a flux is not necessary. Consequently, growing of particle size of CdS occurs with difficulty so that the tolerable range of the firing temperature is wider than that of conventional processes and the particle size can be controlled by the reaction conditions in the first step.

The reaction in the first step is considered to proceed according to the following formula:

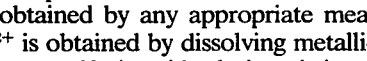

$$Cd^{2+} + M + S^{2-} \rightarrow CdS\ (\alpha M)$$

where M is an impurity and $\alpha M$ means that it is not clear in what form M is present in CdS and the amount of M is very little. The reaction is preferably conducted in an aqueous solution of sulfuric acid. The $Cd^{2+}$ may be obtained by any appropriate means. For example $Cd^{2+}$ is obtained by dissolving metallic cadmium in an aqueous sulfuric acid solution nitric acid, or by dissolving $CdSO_4$ in water.

The amount of $Cd^{2+}$ is selected in such a manner that the reaction proceeds effectively. When the $Cd^{2+}$ amount is too small, the reaction with $S^{2+}$ hardly occurs and a long period of time is necessary to complete the reaction and the particle size of the resulting CdS is undesirably small. On the contrary, when the $Cd^{2+}$ amount is too much, the particle size of the resulting CdS is more than 10 microns and is not suitable for electrophotography. the amount of $Cd^{2+}$ in the reaction system is preferably from ½ M. to 3/2 M. as a concentration of $CdSO_4$.

$S^{2-}$ in the above reaction formula may be obtained from a water-soluble sulfide, but the reaction control is not so easy and the cation in the sulfide becomes incorporated in the resulting CdS. Therefore, hydrogen sulfide gas is preferable since the reaction control is easy and the undesired effect of the cation is negligible.

The donor impurity is selected from elements of Group IIIa and Group IIIb of the Periodic Table. Preferably Al, In, Ga and Sc are used which have a relatively shallow donor level. In the reaction system, they should be present in ionic form. Therefore, the metals are usually dissolved in an acid or the water-soluble salts, for example, the sulfates such as $Al_2(SO_4)_3$, $In_2(SO_4)_3$, $Ga_2(SO_4)_3$, $Sc_2(SO_4)_3$ and the like, and the nitrates are dissolved in the reaction system to form the respective metal ions. The amount of the donor directly affects the sensitivity. CdS containing only a sall amount of the donor impurity is of low sensitivity for electrophotography and gives foggy images. On the contrary, CdS containing a large amount of the donor impurity shows a high dark decay and gives low apparent resistance and only an extremely pale image is obtained, and therefore, such CdS is not suitable for electrophotography. The preferable donor amount ranges from $0.5 \times 10^{-3}$ to $6 \times 10^{-3}$ ion/mole of CdS.

As the acceptor impurity, there is preferably used an element of Group Ib of the Periodic Table. For example, when the acceptor is added to the first step, Cu, Ag or Au may be dissolved in an aqueous solution and added as such, or a water-soluble salt such as $CuSO_4$, $AgNO_3$, $Au(CN)_3 \cdot 3H_2O$ and the like may be directly dissolved in the reaction system. When the acceptor is added to the second step, it may be added in a way similar to the above. The amount of the acceptor preferably ranges from $1 \times 10^{-4}$ to $20 \times 10^{-4}$ ion/mole of CdS.

It is preferable that sulfuric acid be present in the reaction system since it can prevent redissolution of the CdS and controls the particle size. The particle size of CdS depends on the concentration of sulfuric acid in the reaction system. At the concentration lower than 1 N. sulfuric acid, the resulting particle size of CdS is very small while at the concentrations higher than 4 N., the particle size becomes unsatisfactorily large. Therefore, the concentration of sulfuric acid in the reaction system is preferably from 1 N. to 4 N. for the purpose of obtaining a preferable particle size of from one to several microns.

The reaction temperature of the reaction system is also one of the important factors for controlling the rate of reaction and particle size of CdS. At temperatures lower than 40° C, the reaction proceeds very slowly to form small particles while at temperatures higher than 80° C the reaction proceeds very rapidly to form large particles and the resulting particles are plate-shaped. Therefore, the reaction temperature is preferably from 40° C to 80° C.

In addition, it is preferable to stir the reaction system upon blowing hydrogen sulfide therethrough so as to make the reaction effectively proceed. This stirring gives CdS particles of a uniform particle size distribution.

The resulting CdS containing the donor impurity and the acceptor impurity of CdS containing the donor impurity obtained in the first step is washed and dried and then subjected to the second step procedure.

In the second step, if the CdS does not yet contain the acceptor impurity, the acceptor impurity is added to the CdS. The CdS containing both the donor and the acceptor impurities is fired in an inert gas atmosphere to dope the CdS with the impurities. The firing is effected at temperatures which do not cause sintering, but which still can dope the CdS with the impurities. According to the present invention, the upper limit of firing temperature is extended because no flux is necessary, but the lower limit is almost the same as that in prior art processes.

After firing, the resulting doped CdS is washed and dried to give the final product. In the washing, the electroconductivity of the washing waste water after several times of washing is lowered and becomes almost the same as that of the original washing water. On the contrary, upon washing CdS produced by the prior art process, the electroconductivity of the washing waste water even after several times of washing is not lowered. The above matters are shown in FIG. 1 in the attached drawing. This indicates that the impurities for doping used in the present invention are not lost by washing while those in the prior art are continuously lost into the washing water during the washing procedure. It is clear from the above that the amount of the impurities can be easily controlled by adding a desirable amount of them from the beginning according to the present invention.

The CdS produced by the process of the present invention may be dispersed in a binder resin and then coated on a conductive substrate to form a photosensitive plate of two-layer structure, which can be used for the Carlson process to produce images. If desired, an insulating layer may be overlaid on the above-mentioned two-layer photosensitive plate to give a three-layer photosensitive plate. When this three layer photosensitive plate is subjected to charging at +6KV, imagewise exposure simultaneously with charging at AC 6KV and blanket exposure, there is obtained a clear and sharp image having a contrast higher than 500v, and free from fog and the sensitivity is less than 3.5 lux. sec.

The following examples are set forth for purposes of illustration only and are not to be constructed as limitations on the present invention except as set forth in the appended claims.

EXAMPLE 1

Hydrogen sulfide was blown into 2 l. of a sulfuric acid aqueous solution containing 1 mole of cadmium sulfate $10^{-3}$ mole of, indium sulfate, and $5 \times 10^{-4}$ mole of cupric sulfate, with stirring at 60° C at a rate of 1 liter/-min. for 100 minutes. The precipitated cadmium sulfide was washed, dried, placed in a quartz tube and fired in a nitrogen atmosphere at 500° C for 60 minutes. The fired product was washed, and dried to obtain the final product CdS which was excellent in quantitative reproducibility.

Dispersing this CdS in a binder comprising vinylchloride vinyl acetate copolymer to produce a photoconductive layer, an insulating film was adhered to the surface of said layer to form a three layered photosensitive plate. This photosensitive plate was subjected to charging of +6KV, charging of AC 6KV simultaneously with imagewise exposure and blanket radiation to give a contrast of 700v and a sensitivity of 2.5 lux. sec. That is, there was obtained clear images of high contrast free from fog.

EXAMPLES 2 – 13

Following the procedure of Example 1 except that the conditions shown in the table below were used in place of those in Example 1, there were obtained the results as shown in the following table.

| Example No. | $CdSO_4$ mole | $In_2(SO_4)_3$ $10^{-3}$ mole | Cu $\times 10^4$ ion | Normality N | Reaction Condition ° C | Firing Condition ° C | Contrast V | Sensitivity lux. sec. |
|---|---|---|---|---|---|---|---|---|
| 2 | 1 | 1.0 | 5 | 1 | 80 | 500 | 600 | 3.5 |
| 3 | 1 | 1.0 | 5 | 4 | 40 | 500 | 550 | 3.5 |
| 4 | 1 | 1.0 | 5 | 1 | 60 | 520 | 640 | 3.0 |
| 5 | 1 | 1.0 | 5 | 4 | 60 | 480 | 600 | 3.5 |
| 6 | 1 | 2.0 | 8 | 2 | 70 | 450 | 580 | 2.8 |
| 7 | 1 | 3.0 | 1 | 3 | 50 | 550 | 540 | 3.0 |
| 8 | 1 | 0.5 | 5 | 2 | 60 | 590 | 600 | 2.8 |
| 9 | 1 | 1.5 | 6 | 2 | 60 | 500 | 680 | 2.2 |
| 10 | 3 | 1.0 | 5 | 2 | 60 | 500 | 640 | 3.3 |
| 11 | 2 | 1.0 | 5 | 2 | 60 | 520 | 660 | 3.0 |
| 12 | 1 | 0.25 | 10 | 2 | 70 | 560 | 550 | 3.8 |
| 13 | 1 | 2.0 | 20 | 2 | 65 | 500 | 600 | 3.0 |

EXAMPLE 14

Hydrogen sulfide was blown into 2 l of a 2N sulfuric acid aqueous solution containing 1 mole of cadmium sulfate, $5 \times 10^{-3}$ mole of aluminum sulfate, and $5 \times 10^{-4}$ mole of cupric sulfate at a rate of one liter/min. for 100 minutes at 40° C with stirring, and cadmium sulfide was produced as a precipitate containing aluminium and copper. The precipitate was washed with water, filtered, dried, placed in a quartz tube, and fired at 500° C for 60 minutes in a nitrogen atmosphere to dope the same with aluminum and copper.

The cadmium sulfide thus doped was washed to remove unnecessary impurities and dried. The resulting cadmium sulfide was made into a photosensitive plate in a way similar to Example 1, and used in an electrophotographic process similar to Example 1 to obtain clear images of high contrast free from fog. The contrast was 670v and the sensitivity was 2.5 lux sec.

EXAMPLE 15

Hydrogen sulfide was blown into 2 l of a 2N sulfuric acid aqueous solution containing cadmium sulfate (1 mole), gallium sulfate ($3 \times 10^{-3}$ mole), and cupric sulfate ($5 \times 10^{-4}$ mole) at a rate of 1 liter/min. for 100 minutes at 50° C with stirring, and cadmium sulfide was produced as a precipitate containing gallium and copper. The precipitate was washed with water, filtered, dried, placed in a quartz tube, and fired at 500° C for 60 minutes in a nitrogen atmosphere to dope the same with gallium and copper.

The cadmium sulfide thus doped was washed to remove unnecessary impurities and dried. The resulting cadmium sulfide was made into a photosensitive plate in a way similar to Example 1, and used in an electrophotographic process similar to Example 1 to obtain clear images of high contrast free from fog. The contrast was 620v and the sensitivity was 3.0 lux/sec.

EXAMPLE 16

Hydrogen sulfide was blown into 2 l of a 2N sulfuric acid aqueous solution containing cadmium sulfate (1 mole), indium sulfate ($2 \times 10^{-3}$ mole), and silver nitrate ($10^{-4}$ mole) at a rate of 1 liter/min. for 100 minutes at 60° C with stirring, and cadmium sulfide was produced as a precipitate containing indium and silver. The precipitate was washed with water, filtered, dried, placed in a quartz tube, and fired at 500° C for 60 minutes in a nitrogen atmosphere to dope the same with indium and silver.

The cadmium sulfide thus doped was washed to remove unnecessary impurities and dried. The resulting cadmium sulfide was made into a photosensitive plate in a way similar to Example 1, and used in an electrophotographic process similar to Example 1 to obtain clear images of high contrast free from fog. The contrast was 650v and the sensitivity was 2.7 lux. sec.

EXAMPLE 17

Hydrogen sulfide was blown into 2 l. of a 3N sulfuric acid aqueous solution containing cadmium sulfate (1 mole) and indium sulfate ($10^{-3}$ mole) at a rate of 1 liter/min. for 100 minutes at 60° C with stirring, and cadmium sulfide was produced as a precipitate containing indium. The precipitate was washed with water, filtered, dried, placed in a quartz tube together with cupric sulfate $10^{-3}$ mole and fired at 500° C for 60 minutes in a nitrogen atmosphere to dope the same indium and copper.

The cadmium sulfide thus doped was washed to remove unnecessary impurities and dried. Dispersing the resulting CdS in a binder comprising vinylchloride-vinyl acetate copolymer to produce a photoconductive layer, an insulating film was adhered to the surface of said layer to form a three layered photosensitive plate. This photosensitive plate was subjected to charging of +6KV, charging of AC 6KV simultaneously with imagewise exposure and blanket radiation to give a contrast of 650v and a sensitivity of 2.8 lux. sec. That is, there was obtained clear images of high contrast free from fog.

EXAMPLE 18

Metallic cadmium (100g), copper powder (0.017g), and aluminum powder (0.01g) were completely dissolved in 1.5 l of a 2N sulfuric acid aqueous solution containing nitric acid. Hydrogen sulfide was blown into the resulting aqueous solution at a rate of 1 liter/min. for 100 minutes at 60° C with stirring to precipitate fine crystals. The fine crystals were filtered, washed, dried, fired at 550° C for 60 minutes to dope the same copper and aluminum.

The cadmium sulfide thus doped was washed to remove unnecessary impurities and dried. The resulting cadmium sulfide was made into a photosensitive plate in a way similar to Example 1, and used in an electrophotographic process similar to Example 1 to obtain clear images of high contrast free from fog. The contrast was 600v and the sensitivity was 3.0 lux. sec.

EXAMPLE 19

Hydrogen sulfide was blown into 2 l. of a 2N sulfuric acid aqueous solution containing cadmium sulfate (1 mole), scandium sulfate ($1 \times 10^{-3}$ mole), and cupric sulfate ($5 \times 10^{-4}$ mole) at a rate of 1 liter/min. for 100 minutes at 60° C with stirring, and cadmium sulfide was produced as a precipitate containing scandium and copper. The precipitate was washed with water, filtered, dried, placed in a quartz tube, and fired at 500° C for 60 minutes in a nitrogen atmosphere to dope the same with scandium and copper.

The cadmium sulfide thus doped was washed to remove unnecessary impurities and dried. The resulting cadmium sulfide was made into a photosensitive plate in a way similar to Example 1, and used in an electrophotographic process similar to Example 1 to obtain clear images of high contrast free from fog. The contrast was 550V and the sensitivity was 3.5 lux. sec.

We claim:

1. A process for producing donor and acceptor impurity-doped CdS having a fine particle size and useful in electrophotography wherein the amount of doped impurities in the CdS can be quantitatively controlled and wherein the particle size can be controlled, said process comprising the steps of:

1. contacting sulfide ion with cadmium ion and a measured amount of a donor impurity element selected from the group consisting of elements of Groups IIIa and IIIb of the Periodic Table in an aqueous 1N to 4N sulphuric acid solution to suppress formation of coarse CdS particles and form fine CdS particles containing said donor impurity;
2. firing the resulting CdS particles containing said donor impurity in the absence of a flux at a temperature high enough to dope said CdS particles with said donor impurity but not high enough to cause sintering of said CdS particles to control the CdS particle size by suppressing formation of large CdS particles; and
3. adding a measured amount of an acceptor impurity during either step (1) or step (2), wherein said firing dopes with CdS with a quantitatively-controlled amount of said donor and acceptor impurities.

2. A process according to claim 1, in which cadmium ion is derived from $CdSO_4$.

3. A process according to claim 1, in which step (1) is conducted in an aqueous reaction medium and in which cadmium ion is obtained by dissolving metallic cadmium in said aqueous reaction medium.

4. A process according to claim 1, in which the acceptor impurity is an element of Group Ib of the Periodic Table and is added in step (1).

5. A process according to claim 1, in which the acceptor impurity is an element of Group Ib of the Periodic Table and is added at the firing step.

6. A process according to claim 1, in which said step (1) includes dissolving a cadmium forming material, the donor impurity and an acceptor impurity selected from elements of Group Ib of the Periodic Table in an aqueous sulfuric acid solution and blowing $H_2S$ gas through the resulting solution at an appropriate temperature with stirring; and then firing the resulting CdS.

7. A process according to claim 6, in which the concentration of cadmium ion in said solution ranges from 0.5 M to 1.5 M calculated as $CdSO_4$, the amount of the donor impurity in said CdS ranges from $0.5 \times 10^{-3}$ to $6 \times 10^{-3}$ ion/mole of CdS and the amount of the acceptor impurity in said CdS ranges from $1 \times 10^{-4}$ to $20 \times 10^{-4}$ ion/mole of CdS.

8. A process according to claim 6, in which the concentration of the sulfuric acid in said solution is 1 – 4N.

9. A process according to claim 6, in which the reaction temperature ranges from 40° C to 80° C.

10. A process according to claim 6, in which the firing temperature ranges from 400° C to 600° C.

11. A process according to claim 5, in which said step (1) includes dissolving a cadmium ion forming material and the donor impurity in an aqueous sulfuric acid solution and blowing $H_2S$ gas through the resulting solution at an appropriate temperature with stirring; and then firing the resulting CdS.

12. A process according to claim 11, in which the concentration of cadmium ion in said solution ranges from 0.5 M to 1.5 M calculated as $CdSO_4$, the amount of the donor impurity in said CdS ranges from $0.5 \times 10^{-3}$ to $6 \times 10^{-3}$ ion/mole of CdS and the amount of the acceptor impurity in said CdS ranges from $1 \times 10^{-4}$ to $20 \times 10^{-4}$ ion/mole of CdS.

13. A process according to claim 11, in which the concentration of the sulfuric acid in said solution is 1 – 4N.

14. A process according to claim 11, in which the reaction temperature ranges from 40° C to 80° C.

15. A process according to claim 11, in which the firing temperature ranges from 400° C to 600° C.

16. A process according to claim 1, in which the donor impurity is a member selected from the group consisting of indium, aluminum, gallium and scandium.

17. Fine particle size, donor and acceptor impurity-doped CdS powder containing a quantitatively-controlled amount of doped impurities and useful in electrophotography; which is produced by contacting sulfide ion with cadmium ion and a measured amount of a donor impurity element selected from the group consisting of elements of Groups IIIa and IIIb of the Periodic Table in an aqueous 1N to 4N sulfuric acid solution to suppress formation of coarse CdS particles and form fine CdS particles containing said donor impurity; firing the resulting CdS particles containing said donor impurity in the absence of a flux at a temperature high enough to dope said CdS particles with said donor impurity but not high enough to cause sintering of said CdS particles to control the CdS particle size by suppressing formation of large CdS particles; and adding a measured amount of an acceptor impurity during either said contacting of said firing step, wherein said firing dopes with said CdS with a quantitatively-controlled amount of said donor and acceptor impurities.

18. A photoconductive layer which is provided by dispersing the CdS powder of claim 17 in a binder.

19. A photosensitive plate which has the photoconductive layer according to claim 18.

20. A photoconductive plate which comprises a support layer, a photoconductive layer according to claim 18 and an insulating layer in the order as mentioned.

21. A process according to claim 3, wherein said aqueous reaction medium contains nitric acid.

22. A process according to claim 6, wherein said sulfuric acid solution contains nitric acid.

23. A process according to claim 11, wherein said sulfuric acid solution contains nitric acid.

24. A process according to claim 6, wherein said donor impurity is added to said solution in the form of a watersoluble salt thereof.

25. A process according to claim 11, in which the donor impurity is added to said solution in the form of a watersoluble salt thereof.

26. A process according to claim 6, in which the acceptor impurity is added to said solution in the form of a watersoluble salt thereof.

27. A process according to claim 11, in which the acceptor impurity is added to said solution in the form of a watersoluble salt thereof.

28. A process for producing donor and acceptor impurity-doped CdS having a fine particle size and useful in electrophotography wherein the amount of doped impurities in the CdS can be quantitatively controlled and where the particle size can be controlled, which process comprises the steps of:

1. contacting, in a 1 – 4N aqueous sulfuric acid solution, sulfide ion derived from hydrogen sulfide, cadmium ion in a concentration in said solution of from 0.5 M to 1.5 M calculated as $CdSO_4$, a measured amount of from $0.5 \times 10^{-3}$ to $6 \times 10^{-3}$ ion/mole of CdS of a donor impurity ion selected from the group consisting of Al, In, Ga, and Sc, and a measured amount of from $1 \times 10^{-4}$ to $20 \times 10^{-4}$ ion/mole of CdS of an acceptor impurity ion selected from the group consisting of Cu, Ag and Au, with stirring at a temperature of from 40° to 80° C. to suppress formation of coarse CdS particles and produce fine CdS particles containing said donor and acceptor impurities; and
2. then firing the resulting CdS in the absence of a flux at a temperature of from 400° to 600° C, to control the CdS particle size by suppressing formation of large CdS particles and dope with CdS with a quantitatively-controlled amount of said donor and acceptor impurities.

29. A process according to claim 28, further comprising washing and drying the CdS after both of steps (1) and (2).

30. A process according to claim 29, wherein said sulfuric acid solution contains nitric acid.

31. A process for producing donor and acceptor impurity-doped CdS having a fine particle size and useful in electrophotography wherein the amount of doped impurities in the CdS can be quantitatively-controlled and where the particle size can be controlled, which process comprises the steps of:

1. contacting in a 1 – 4N aqueous sulfuric acid solution, sulfide ion derived from hydrogen sulfide, cadmium ion in a concentration in said solution of from 0.5 M to 1.5 M calculated as $CdSO_4$, and a measured amount of from $0.5 \times 10^{-3}$ to $6 \times 10^{-3}$ ion/mole of CdS of a donor impurity ion selected from the group consisting of Al, In, Ga and Sc, with stirring at a temperature of from 40° to 80° C. to suppress formation of coarse CdS particles and to produce fine CdS particles containing said donor impurity; and
2. adding a measured amount of from $1 \times 10^{-4}$ to $20 \times 10^{-4}$ ion/mole of CdS of an acceptor impurity ion selected from the group consisting of Cu, Ag and Au to the resulting CdS and then firing the resulting CdS in the absence of a flux at a temperature of from 400° to 600° C, to control the CdS particle size by suppressing formation of large CdS particles and dope said CdS with a quantitatively-controlled amount of said donor and acceptor impurities.

32. A process according to claim 31, further comprising the steps of washing and drying the CdS after both of steps (1) and (2).

33. A process according to claim 32, wherein said sulfuric acid solution contains nitric acid.

34. A process according to claim 1 in which the firing step (2) is conducted in the absence of a flux.

35. A process according to claim 28 in which said firing step (2) is conducted in the absence of a flux.

36. A process according to claim 31, in which the firing step (2) is conducted in the absence of a flux.

* * * * *

UNITED STATES PATENT OFFICE

CERTIFICATE OF CORRECTION

Patent No. 4,021,237 Dated May 26, 1977

Inventor(s) HORUKUNI KAWASHIMA, ET AL

It is certified that error appears in the above-identified patent and that said Letters Patent are hereby corrected as shown below:

Column 3, line 51, change "sall" to --small--

Column 4, line 30, change "of" to --or--

Column 5, line 4, change "500v" to --500 V--

Column 5, line 29, change "700v" to --700 V--

Column 6, line 4, change "670v" to --670 V--

Column 6, line 23, change "620v" to --620 V--

Column 6, line 58, change "650v" to --650 V--

Column 7, line 12, change "650v" to --650 V--

Column 7, line 32, change "600v" to --600 V--

Column 7, line 51, change "550v" to --550 V--

Column 8, line 7, change "with" to --said--

Column 8, line 23, change "cadmium forming" to --cadmium ion forming--

Column 9, line 14, change "of" to --or--

Column 9, line 15, delete "with" first occurrence

Column 10, line 10, change "with" first occurrence to --said--

UNITED STATES PATENT OFFICE
CERTIFICATE OF CORRECTION

Patent No. 4,021,237 Dated May 26, 1977

Inventor(s) HORUKUNI KAWASHIMA, ET AL

It is certified that error appears in the above-identified patent and that said Letters Patent are hereby corrected as shown below:

Column 3, line 21, after "solution" insert --containing--

Column 5, Table Heading 3rd line, change "$10^{-3}$ mole" to --x $10^{-3}$ mole--

Column 7, line 24, after "same" insert --with--

Signed and Sealed this second Day of August 1977

[SEAL]

*Attest:*

RUTH C. MASON
*Attesting Officer*

C. MARSHALL DANN
*Commissioner of Patents and Trademarks*